US008019239B2

(12) United States Patent
Nakayama et al.

(10) Patent No.: US 8,019,239 B2
(45) Date of Patent: Sep. 13, 2011

(54) DEVICE AND METHOD FOR DETECTING LIFE OF ORGANIC PHOTORECEPTOR AND IMAGE FORMING APPARATUS

(75) Inventors: Masayoshi Nakayama, Ibaraki (JP); Shinichi Akatsu, Ibaraki (JP); Tomohide Takenaka, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 68 days.

(21) Appl. No.: 12/623,839

(22) Filed: Nov. 23, 2009

(65) Prior Publication Data

US 2010/0129093 A1 May 27, 2010

(30) Foreign Application Priority Data

Nov. 25, 2008 (JP) ..... 2008-299961

(51) Int. Cl.
*G03G 15/00* (2006.01)

(52) U.S. Cl. ..... 399/26

(58) Field of Classification Search ..... 399/24, 399/26, 31, 44

See application file for complete search history.

(56) References Cited

U.S. PATENT DOCUMENTS

| | | | | |
|---|---|---|---|---|
| 5,225,873 | A * | 7/1993 | Lux et al. | 399/26 |
| 6,738,585 | B2 * | 5/2004 | Shin et al. | 399/26 |
| 7,263,299 | B2 * | 8/2007 | Nagamochi et al. | 399/26 |
| 2005/0141903 | A1 * | 6/2005 | Kwon | 399/24 |
| 2007/0274742 | A1 | 11/2007 | Nakayama et al. | |
| 2007/0280744 | A1 | 12/2007 | Kubo et al. | |
| 2008/0019718 | A1 | 1/2008 | Akatsu et al. | |
| 2008/0199205 | A1 | 8/2008 | Kubo et al. | |
| 2008/0199223 | A1 | 8/2008 | Tateyama et al. | |
| 2008/0213006 | A1 | 9/2008 | Nakayama et al. | |
| 2008/0247786 | A1 | 10/2008 | Nakayama et al. | |
| 2009/0103954 | A1 | 4/2009 | Nakayama et al. | |

FOREIGN PATENT DOCUMENTS

| | | |
|---|---|---|
| JP | 5-14729 | 1/1993 |
| JP | 8-95317 | 4/1996 |
| JP | 9-185218 | 7/1997 |
| JP | 9-190120 | 7/1997 |
| JP | 11-109688 | 4/1999 |
| JP | 2000-347545 | 12/2000 |
| JP | 2002-82578 | 3/2002 |
| JP | 3375021 | 11/2002 |
| JP | 2005-17512 | 1/2005 |
| JP | 2006-139272 | 6/2006 |

* cited by examiner

*Primary Examiner* — Sandra L Brase
(74) *Attorney, Agent, or Firm* — Oblon, Spivak, McClelland, Maier & Neustadt, L.L.P.

(57) ABSTRACT

A device for determining an end of life of an organic photoreceptor includes a potential detecting unit that detects a residual potential of the organic photoreceptor, a temperature detecting unit that detects temperature of the organic photoreceptor in either one of a direct manner and an indirect manner, and a life determining unit that determines the end of life of the organic photoreceptor based on the residual potential detected by the potential detecting unit and the temperature detected by the temperature detecting unit.

17 Claims, 3 Drawing Sheets

DEVICE AND METHOD FOR DETECTING LIFE OF ORGANIC PHOTORECEPTOR AND IMAGE FORMING APPARATUS

CROSS-REFERENCE TO RELATED APPLICATIONS

The present application claims priority to and incorporates by reference the entire contents of Japanese Patent Application No. 2008-299961 filed in Japan on Nov. 25, 2008.

BACKGROUND OF THE INVENTION

1. Field of the Invention

The present invention relates to a technology for determining life of a photoreceptor in an image forming apparatus.

2. Description of the Related Art

Conventionally, there has been a type of image forming apparatus that electrostatically forms an electrostatic latent image on a surface of a photoreceptor, develops the latent image by toner, and a toner image is transferred to a recording medium such as paper and is fixed thereon, thereby forming a printed matter. In this type of image forming apparatus, a photoreceptor layer on a surface of a photoreceptor can be worn due to frictions by a developer on a cleaning blade or in a developing nip, or can fatigue due to repetitions of charging and neutralization. Therefore, the photoreceptor needs to be replaced regularly according to the service life of thereof.

Types of photoreceptors used in an image forming apparatus include a selenium photoreceptor, an amorphous silicone photoreceptor, and an organic photoreceptor. The selenium photoreceptor and the amorphous silicone photoreceptor have an advantage in that they have a longer service life because of high surface hardness and scrape resistance. However, the selenium photoreceptor needs to be collected after use because of environmental consideration or the like, and thus it is used only in a part of high-speed machines. The amorphous silicone photoreceptor has a lower surface resistance than other types of photoreceptors, and particularly, the amorphous silicone photoreceptor has a disadvantage in that an electrostatic latent image is disturbed in a high-temperature and constant-humidity environment, and this can cause a phenomenon referred to as "image deletion". Further, in the amorphous silicone photoreceptor, the rate of dark decay is very high as compared to other types of photoreceptors because of the low surface resistance, and a charge potential is not stable in a developing unit away from a charging unit (with a time passed since being charged), because temperature dependency of the rate of dark decay is very large. From these reasons, the amorphous silicone photoreceptor is generally mounted with a heater to control its temperature to be constant by detecting the temperature thereof. Further, to reduce cost, there has been proposed a method of temperature detection of a photoreceptor to control the charge potential of the photoreceptor and development bias according to the detected temperature, without performing temperature control of the photoreceptor by a heater (for example, see Japanese Patent Application Laid-open No. H9-185218 and Japanese Patent Application Laid-open No. H11-109688). Meanwhile, the organic photoreceptor has been most widespread because of a reasonable production cost; however, the organic photoreceptor has a disadvantage in that it is easily scraped due to low surface hardness, and thus its service life is short. Therefore, when an organic photoreceptor is used, it is very important to accurately determine the service life thereof. The temperature dependency of the organic photoreceptor is very low as compared to that of the amorphous silicone photoreceptor, and thus, conventionally, with regard to detection of the temperature of the organic photoreceptor and prediction of the service life thereof, the temperature of the organic photoreceptor itself has not been focused.

Conventionally, endurance tests or the like are performed beforehand in a standard environment and use condition to obtain the number of prints and cumulative number of revolutions of a photoreceptor until it reaches the end of the service life, and the service life is set based on the results of the tests. However, because the service life of the photoreceptor largely depends on a use environment and use condition of an image forming apparatus that uses the photoreceptor, it is difficult to accurately predict the service life. Therefore, in practice, before reaching the number of prints set as a preset service life, printed matters having a considerable defect in quality may be output, or replacement of the photoreceptor may be performed although it is still sufficiently useful.

Therefore, a method of detecting a fatigue state of a photoreceptor to determine the service life thereof based on its detection result has been proposed. For example, as a method of detecting a fatigue state of a photoreceptor, there has been proposed a method of detecting a surface potential of a photoreceptor to determine the service life thereof based on its detection result. For example, Japanese Patent Application Laid-open No. H9-190120 discloses a method of determining the service life of a photoreceptor by comparing a detected saturated potential and a residual potential to a preset potential value. Japanese Patent Application Laid-open No. 2006-139272 discloses a method of determining the service life of a photoreceptor according to a difference between a charge potential and a residual potential.

However, in the methods disclosed in Japanese Patent Application Laid-open No. H9-190120 and Japanese Patent Application Laid-open No. 2006-139272, the service life is determined by a measured residual potential itself, and the temperature dependency of a residual potential of an organic photoreceptor is not taken into consideration. In these methods, determination of the service life of the photoreceptor is performed according to mixed information elements including a change in the residual potential due to deterioration of the photoreceptor and a change in the residual potential due to a temperature change of the photoreceptor. Therefore, there is no accuracy in determining the service life, and the determination can be erroneous in some cases. Particularly, in a case that immediately after an apparatus is switched on in the winter season where an external temperature is low, the temperature of the photoreceptor is low and the residual potential becomes very high, and thus the service life of the photoreceptor can be detected erroneously.

SUMMARY OF THE INVENTION

It is an object of the present invention to at least partially solve the problems in the conventional technology.

According to one aspect of the present invention, there is provided a device for determining an end of life of an organic photoreceptor. The device includes: a potential detecting unit that detects a residual potential of the organic photoreceptor; a temperature detecting unit that detects temperature of the organic photoreceptor in either one of a direct manner and an indirect manner; and a life determining unit that determines the end of life of the organic photoreceptor based on the residual potential detected by the potential detecting unit and the temperature detected by the temperature detecting unit.

Furthermore, according to another aspect of the present invention, there is provided a method of determining an end of life of an organic photoreceptor. The method includes: first detecting including detecting a residual potential of the organic photoreceptor; second detecting including detecting temperature of the organic photoreceptor in either one of a direct manner and an indirect manner; and determining the end of life of the organic photoreceptor based on the residual potential detected at the first detecting and the temperature detected at the second detecting.

Moreover, according to still another aspect of the present invention, there is provided an image forming apparatus that includes an organic photoreceptor, a neutralizing unit that neutralizes a surface of the organic photoreceptor, a charging unit that uniformly charges the surface of the organic photoreceptor that is neutralized by the neutralizing unit, a latent-image forming unit that forms an electrostatic latent image on the surface of the organic photoreceptor, a developing unit that develops the electrostatic latent image formed on the surface of the organic photoreceptor. The image forming apparatus further includes a photoreceptor life determining device for determining an end of life of the organic photoreceptor. The photoreceptor life determining device includes a potential detecting unit that detects a residual potential of the organic photoreceptor, a temperature detecting unit that detects temperature of the organic photoreceptor in either one of a direct manner and an indirect manner, and a life determining unit that determines the end of life of the organic photoreceptor based on the residual potential detected by the potential detecting unit and the temperature detected by the temperature detecting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 1:
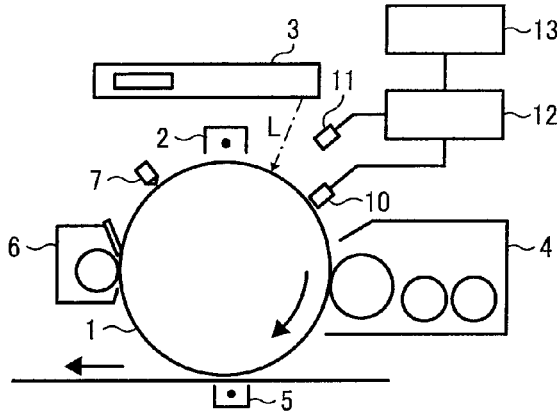
FIG. 1 is a schematic configuration diagram of relevant parts of a printer according to an embodiment of the present invention.

An example in which the present invention is applied to an electrophotographic laser printer, which is an image forming apparatus, is explained below as an embodiment of the present invention. A configuration and an operation of a printer according to the present embodiment are explained first. FIG. 1 is a schematic configuration diagram of the printer according to the present embodiment in its entirety. The printer includes a drum-shaped organic photoreceptor 1, which rotates in a direction of an arrow in FIG. 1. The printer includes, around the organic photoreceptor 1, a charger 2 as a charging unit that uniformly charges a surface of the organic photoreceptor 1, an exposure device 3 as a latent-image forming unit that forms an electrostatic latent image by exposing the charged surface of the organic photoreceptor 1 to laser light L, a developing device 4 as a developing unit that brings toner to adhere to the electrostatic latent image to develop an image, a transfer device 5 as a transfer unit that transfers a toner image on the organic photoreceptor 1 obtained by development onto transfer paper, a cleaning device 6 as a cleaning unit that cleans transfer residual toner on the surface of the organic photoreceptor 1, and a neutralizing device 7 that neutralizes residual charges on the surface of the organic photoreceptor 1, and these devices are arranged in this order.

In the printer with the above configuration, an original image signal read from an original by an image reading unit (not shown), or an original image signal generated by an external computer (not shown) or the like is input to an image processor (not shown) to perform appropriate image processing. An input image signal obtained in this manner is input to the exposure device 3, to modulate laser light L. The laser light L modulated by the input image signal is irradiated onto the surface of the organic photoreceptor 1 uniformly charged by the charger 2. When the laser light L is irradiated onto the surface of the organic photoreceptor 1, an electrostatic latent image corresponding to the input image signal is formed on the organic photoreceptor 1. The electrostatic latent image formed on the organic photoreceptor 1 is developed with the toner by the developing device 4, thereby forming a toner image on the organic photoreceptor 1. The toner image formed on the organic photoreceptor 1 is carried toward the transfer device 5 arranged opposite to the organic photoreceptor 1, with rotations of the organic photoreceptor 1 in the direction of the arrow in FIG. 1. Meanwhile, transfer paper is carried from a paper feed unit (not shown) toward a transfer nip between the organic photoreceptor 1 and the transfer device 5, and the toner image on the organic photoreceptor 1 is transferred onto the transfer paper by the transfer device 5. The transfer paper having the transferred toner image is carried to a fixing unit (not shown), where heat and pressure are applied to fix the toner image, and the transfer paper is ejected outside of the printer. Adhered objects such as residual transfer toner remaining on the surface of the organic photoreceptor 1, from which transfer of the toner image to the transfer paper has finished, are cleaned by the cleaning device 6. Further, the residual charges on the surface of the organic photoreceptor 1 are neutralized by the neutralizing device 7, to finish a sequence of an image forming operation.

Figure 2:
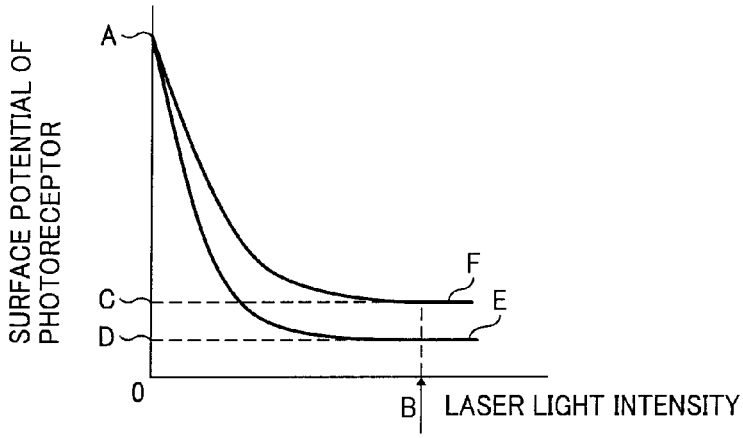
FIG. 2 is a characteristic diagram of an example of a relation between intensity of laser light irradiated to an organic photoreceptor and a surface potential of the organic photoreceptor.
Figure 3:
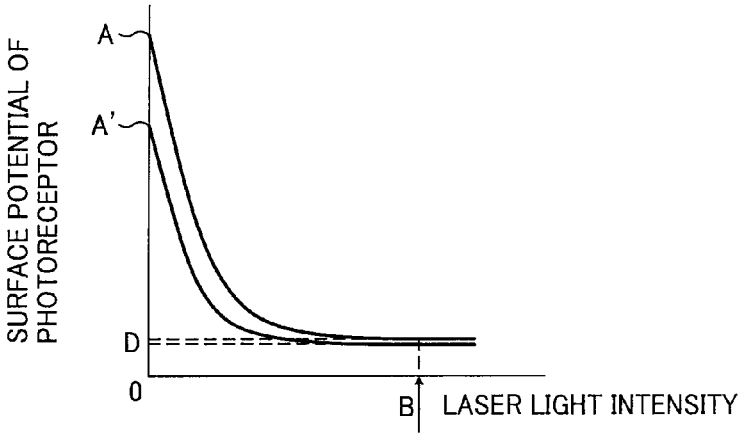
FIG. 3 is a characteristic diagram of another example of a relation between intensity of laser light irradiated to an organic photoreceptor and a surface potential of the organic photoreceptor.

A relation between a surface potential of the organic photoreceptor 1 and intensity of laser light is explained. FIG. 2 is a characteristic diagram indicating an influence of the temperature of the organic photoreceptor with respect to a relation between the intensity of laser light irradiated to the organic photoreceptor 1 and the surface potential of the organic photoreceptor 1. FIG. 3 is a characteristic diagram indicating an influence of a charge potential of the organic photoreceptor with respect to a relation between the intensity of laser light irradiated to the organic photoreceptor 1 and the surface potential of the organic photoreceptor 1. As shown in FIG. 2, a photoreceptor surface potential A of the organic photoreceptor 1 when the intensity of laser light is zero corresponds to the charge potential. As the intensity of laser light increases, the photoreceptor surface potential decreases, and the decrease of the photoreceptor surface potential is saturated where the intensity of laser light is sufficiently large. This saturated surface potential is referred to as a residual potential. In the present embodiment, when the residual potential is measured, exposure of the organic photoreceptor 1 is performed with a sufficiently high intensity of laser light of 25, to detect residual potentials C and D in an area where the surface potential of the organic photoreceptor 1 decreases sufficiently to be saturated.

As shown in FIG. 2, the relation between the surface potential of the organic photoreceptor and the intensity of laser light is greatly influenced by the temperature of the organic photoreceptor 1 itself, although the degree of the influence differs according to the type of the organic photoreceptor 1 and a composition thereof. A mechanism in which the relation between the surface potential of the organic photoreceptor and the intensity of laser light is largely influenced by the temperature of the organic photoreceptor 1 itself is explained below. Generally, the organic photoreceptor 1 has a three-layer configuration in which an undercoat layer, a charge generation layer (CGL), and a charge transport layer (CTL) are laminated on a drum element tube in this order from a side close to the drum element tube (inside). While there are organic photoreceptors having no undercoat layer, or organic photoreceptors further having a surface coat layer on an outermost side, the configuration including these three layers is the most basic one.

When the organic photoreceptor 1 is exposed, electric charges are generated from the charge generation layer (CGL) in the exposed portion (positive charges are generated in a negatively charged photoreceptor, and negative charges are generated in a positively charged photoreceptor). Charges generated due to exposure pass the charge transport layer (CTL) and reach the surface to neutralize the charges on the surface of the organic photoreceptor 1 charged by the charger 2. Therefore, the potential in this portion decreases, and an electrostatic latent image is formed on the surface of the organic photoreceptor 1. Further, dark decay occurs because the charges charged by the charger 2 pass through the undercoat layer and leak toward a side of the drum element tube side, which is made of a conductive material, with a lapse of time. The temperature of the organic photoreceptor 1 itself has influences on generation efficiency of the charges in the charge generation layer (CGL), mobility of the charges in the charge transport layer (CTL) (activation level of a site that traps charges in the charge transport layer), and a resistance of the undercoat layer (possibility of leakage). Therefore, the relation between the intensity of laser light and the surface potential of the organic photoreceptor 1 is influenced by the temperature of the organic photoreceptor 1 itself. For example, when the temperature of the organic photoreceptor 1 is relatively high, the relation thereof becomes as shown by a curve E in FIG. 2, and when the temperature of the organic photoreceptor 1 is relatively low, the relation thereof becomes as shown by a curve F in FIG. 2. As described above, the mechanism in which the relation between the intensity of laser light and the surface potential of the organic photoreceptor 1 changes due to the temperature of the organic photoreceptor 1 itself is different from a mechanism of the temperature dependency of an amorphous silicone photoreceptor.

As shown in FIG. 3, the curve indicating the relation between the surface potential of the organic photoreceptor 1 and the intensity of laser light is slightly different according to values of charge potentials A and A'. A value of the residual potential D in an area where exposure is performed with a sufficiently high intensity of laser light B and the surface potential of the organic photoreceptor 1 decreases sufficiently to be saturated is hardly influenced by a change in the charge potential A. However, more accurate information of the change in the residual potential D can be obtained by detecting the residual potential D under a condition that the charge potential A is the same. Therefore, in the printer, if there is enough time for adjusting the charge potential to the same level before measurement of the residual potential, it is more preferable to detect the residual potential with the same level of the charge potential A.

Figure 4:
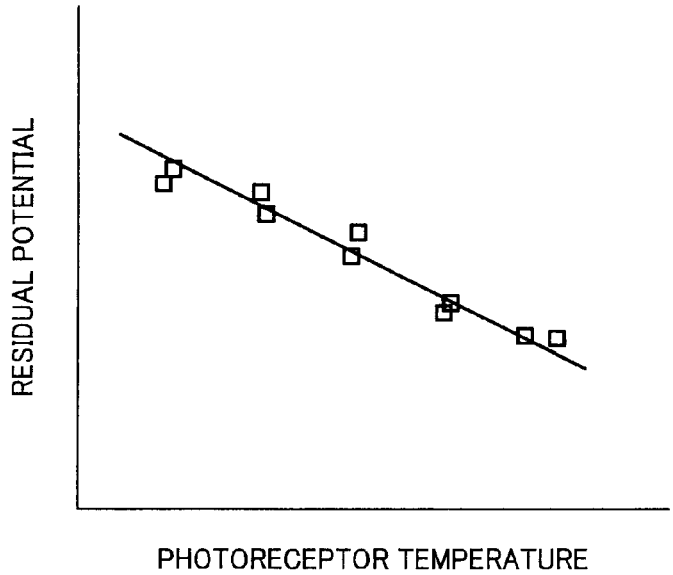
FIG. 4 is a characteristic diagram of an example of a relation between a photoreceptor temperature and a residual potential of the organic photoreceptor.

An example of a relation between the photoreceptor temperature and the residual potential of the organic photoreceptor 1 is shown in FIG. 4. In the organic photoreceptor 1, the photoreceptor temperature and the residual potential are in a linear expression relation, and the organic photoreceptor 1 demonstrates such a characteristic that the residual potential changes by 5 to 6 volts with respect to 1° C. of the photoreceptor temperature.

Figure 5:
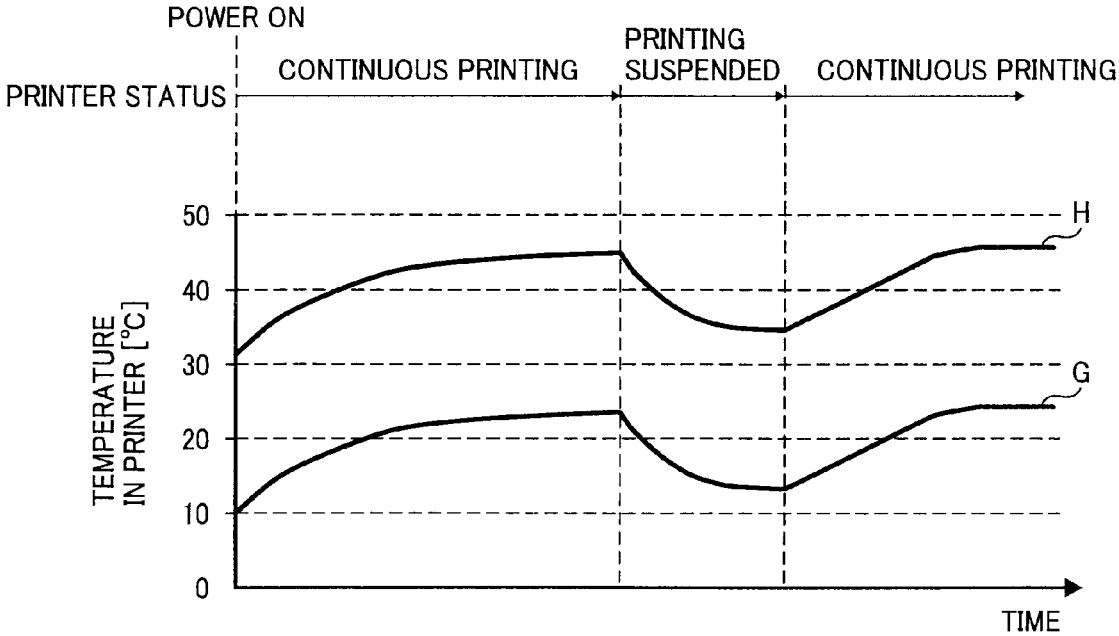
FIG. 5 is a characteristic diagram of an example of transition of a temperature in the printer.

An example of transition of the temperature in the printer is shown in FIG. 5. The temperature in the printer is substantially equal to an outside air temperature when it is not operating. However, when the printer performs a printing operation, the temperature in the printer rises due to heat generated by a fixing unit in the printer, heat generation of a drive motor of each component, and heat generated when a developer is circulated in the developing device 4. Generally, in the printer, a cooling fan that cools inside the printer and discharges the heat generated in the printer to the outside is provided, so that the toner does not melt in the developing device 4 due to the heat generated in the printer. When the printer performs continuous printing, the temperature in the printer becomes stable when the heat generated in the printer and cooling capacity of the cooling fan are balanced. Further, when printing is suspended, because the cooling capacity of the cooling fan surpasses the heat generated in the printer, the temperature in the printer falls. Thereafter, when the printer performs continuous printing, the temperature in the printer rises again to demonstrate transition as shown in FIG. 5. For example, in a case of a printer used in an office, the operation-guaranteed temperature in the use environment is generally from 10° C. to 28° C. or from 10° C. to 32° C. However, because the transition of the temperature in the printer starts from the outside air temperature, the transition is as indicated by a-line G in FIG. 5 when the outside air temperature is 10° C., and the transition is as indicated by a line H in FIG. 5 when the outside air temperature is 32° C.

As described above, the temperature in the printer largely changes due to the use environment and a way of use. Because an aluminum tube having high heat conductivity is mainly used for the organic photoreceptor 1, the temperature of the organic photoreceptor 1 itself changes following the temperature in the printer, and becomes substantially the same temperature as that in the printer. Because the residual potential of the organic photoreceptor 1 has the temperature dependency as explained with reference to FIGS. 2 and 4, the residual potential of the organic photoreceptor 1 largely changes according to the change in the temperature in the printer.

Accordingly, in a case of the organic photoreceptor 1 with a residual potential having large temperature dependency, if the service life is determined by the measured residual potential itself, accurate service life determination of the organic photoreceptor 1 cannot be performed. Therefore, in the present embodiment, a potential sensor 10 as a potential detecting unit that detects the surface potential (residual potential) of the organic photoreceptor 1 after exposure, and a temperature sensor 11 as a temperature detecting unit that detects the temperature of the organic photoreceptor are provided. In the present embodiment, there is further provided a life determining unit 12 as an organic-photoreceptor-life determining unit that determines the service life of the organic photoreceptor based on detection results of the potential sensor and the temperature sensor.

Ideally, the temperature sensor 11 can measure the temperature of the organic photoreceptor 1 directly as a configuration in which a non-contact temperature sensor is placed opposite to the organic photoreceptor 1; however, the temperature sensor 11 can measure the temperature of the organic photoreceptor 1 indirectly. As described above, because an aluminum tube having high heat conductivity is mainly used as the organic photoreceptor 1, the temperature of the organic photoreceptor 1 itself changes following the temperature in the printer. Therefore, the temperature sensor 11 that detects the temperature in the printer can measure the temperature of the organic photoreceptor 1. In this case, a relatively low-cost configuration can be achieved as compared to a case that the temperature of the organic photoreceptor 1 is directly measured by a non-contact temperature sensor.

A life determining method performed by the life determining unit 12 is explained next. The life determining unit 12 corrects a measurement value of the residual potential to a preset value of a standard condition of the photoreceptor temperature (for example, the photoreceptor temperature of 25° C. is set as the standard condition), based on data of the relation between the photoreceptor temperature and the residual potential as shown in FIG. 4 obtained beforehand. The value of the residual potential corrected according to the measurement value of the photoreceptor temperature is used as an index for photoreceptor service life determination. Correction of the residual potential according to the photoreceptor temperature can be performed by simply using a linear expression when the relation between the photoreceptor temperature and the residual potential as shown in FIG. 4 is on the linear expression. When the relation between the photoreceptor temperature and the residual potential has a point of inflection, correction can be performed according to a preset correction table. When the organic photoreceptor 1 is electrically fatigued, charge generation efficiency of the charge generation layer (CGL) and the mobility of charges in the charge transport layer (CTL) decrease, thereby indicating a tendency such that the residual potential increases. The service life of the organic photoreceptor 1 can be determined more accurately than by a conventional organic-photoreceptor-life determining method, by determining that the service life of the photoreceptor has reached when a value of the residual potential corrected based on the measurement value of the photoreceptor temperature exceeds a preset value.

In the printer according to the present embodiment, it is desirable that not only determination whether the organic photoreceptor 1 has reached the service life can be made, but also the service life thereof can be predicted. At a development stage of the printer, it is preferable to previously check what kind of behavior the trend data (time series information) will take, which is obtained by plotting the value of a residual potential corrected by the measurement value of the photoreceptor temperature on a vertical axis, and plotting the cumulative number of revolutions (or travel distance) of the organic photoreceptor 1 on a horizontal axis, until the organic photoreceptor 1 actually reaches the service life.

Figure 6:
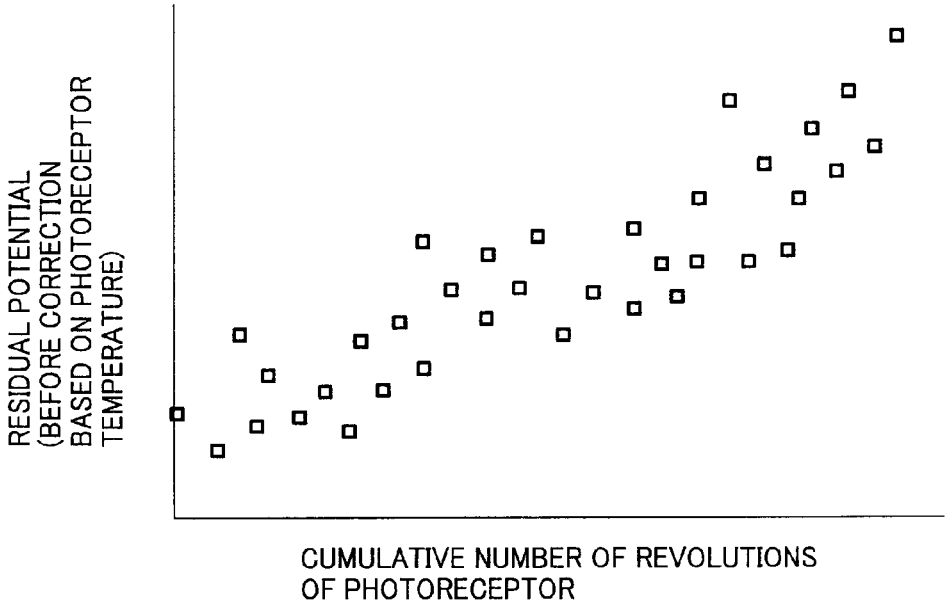
FIG. 6 is a characteristic diagram of an example of a relation between a cumulative number of revolutions and a residual potential of the organic photoreceptor (before correction based on a photoreceptor temperature)
Figure 7:
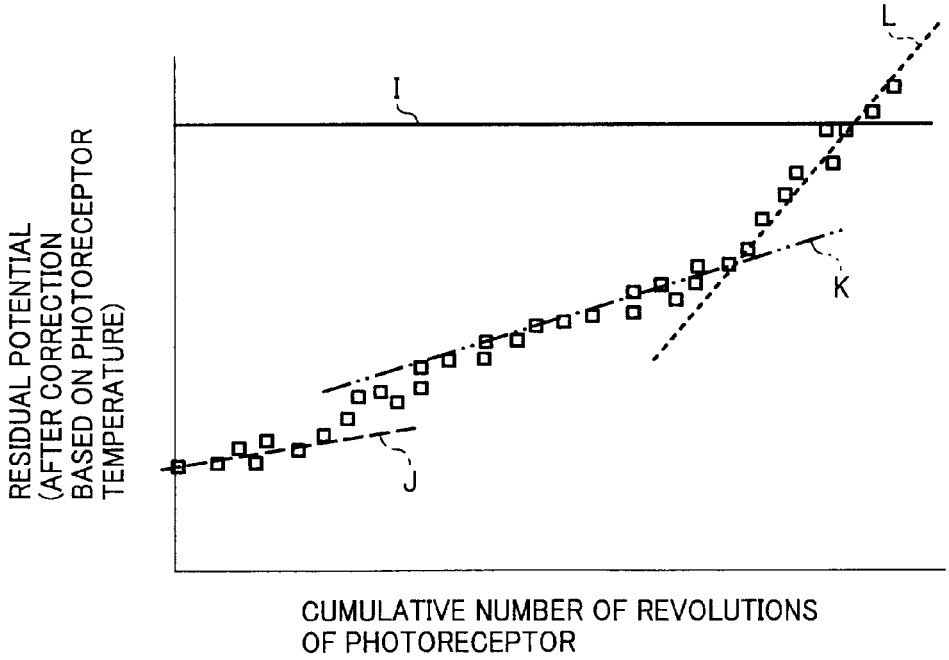
FIG. 7 is a characteristic diagram of an example of a relation between a cumulative number of revolutions and a residual potential of the organic photoreceptor (after correction based on a photoreceptor temperature).

FIG. 6 is measurement data of the residual potential, which is not corrected based on the measurement value of the photoreceptor temperature. FIG. 7 is measurement data of the residual potential, which is corrected based on the measurement value of the photoreceptor temperature. In the trend data of the residual potential shown in FIG. 6, fluctuations are large due to an influence of variations in the temperature in the printer, and it is difficult to calculate a rising slope of the residual potential with respect to the cumulative number of revolutions of the organic photoreceptor 1. On the other hand, in the trend data of the residual potential corrected based on the measurement value of the photoreceptor temperature shown in FIG. 7, fluctuations are small and a stable transition is demonstrated, and thus it is easy to calculate the rising slope of the residual potential with respect to the cumulative number of revolutions of the organic photoreceptor 1. Generally, the residual potential of the organic photoreceptor 1 indicates a rising tendency as the photoreceptor layer is deteriorated. However, the rising rate thereof does not always increase at a constant rate with respect to the cumulative number of revolutions of the organic photoreceptor 1. For example, as shown in FIG. 7, different slopes can be shown, that is, different rising rate can be shown at an initial stage J, a middle stage K, and a late stage L of usage frequency of the organic photoreceptor 1. Slight changes in such a tendency can be detected in the trend data of the residual potential corrected based on the measurement value of the photoreceptor temperature, as compared to the trend data of the residual potential not corrected based on the measurement value of the photoreceptor temperature.

In FIG. 7, the life determining unit 12 determines the life of the photoreceptor when the value of the residual potential corrected based on the measurement value of the photoreceptor temperature exceeds a value of a residual potential value I at the time of preset life of the photoreceptor. Further, the life determining unit 12 calculates a slope of trend data to predict a remaining life, that is, a possible remaining number of prints available, until reaching the service life of the photoreceptor by an extrapolation prediction from the present time or by verification with the slopes ascertained beforehand at the initial stage J, the middle stage K, and the late stage L of usage frequency of the photoreceptor.

The printer according to the present embodiment includes an informing unit 13 such as an operation panel, which is an informing unit that informs the organic photoreceptor 1 has reached the service life. The informing unit 13 has also a function of displaying a predicted value of the remaining life of the organic photoreceptor 1. A user or maintenance personnel can replace the organic photoreceptor at an appropriate timing based on information informed by the informing unit 13 or the like. The user or maintenance personnel can further prearrange the organic photoreceptor for replacement by referring to the predicted value of the remaining life of the organic photoreceptor 1. Also in a case that a user cannot replace the organic photoreceptor 1, a maintenance personnel can efficiently make a plan to visit the user by referring to the predicted value of the remaining life of the organic photoreceptor 1. Accordingly, the downtime of the printer can be reduced and contributing to improvement of productivity as a result.

As described above, according to the printer of the present embodiment, the residual potential of the organic photoreceptor 1 is detected by the potential sensor 10 as a potential detecting unit, and the temperature of the organic photoreceptor is detected simultaneously by the temperature sensor 11 as a temperature detecting unit. The life determining unit 12 then determines the service life of the organic photoreceptor 1 based on the detection values thereof. Accordingly, the service life of the organic photoreceptor 1 can be accurately determined, as compared to conventional service life determination, which does not take the temperature dependency of the residual potential of the organic photoreceptor 1 into consideration.

According to the printer of the present embodiment, because the temperature of the organic photoreceptor 1 changes following the temperature change in the printer, the temperature of the organic photoreceptor 1 can be indirectly detected by detecting the temperature in the printer by the temperature sensor 11. Further, the temperature sensor 11 can have a relatively low-cost configuration as compared to a case that the temperature of the organic photoreceptor 1 is directly detected by a non-contact temperature sensor or the like.

According to the printer of the present embodiment, the value of the residual potential of the organic photoreceptor 1 corrected based on the temperature of the organic photoreceptor 1 is used as an index for service life determination of the organic photoreceptor 1. Therefore, service life determination of the organic photoreceptor 1 can be accurately performed, regardless of the temperature dependency of the residual potential of the organic photoreceptor 1.

According to the printer of the present embodiment, service life determination of the organic photoreceptor 1 can be performed more accurately, according to the trend data, which is the time series information of the residual potential of the organic photoreceptor 1 corrected based on the temperature of the organic photoreceptor 1.

According to the printer of the present embodiment, the service life of the organic photoreceptor 1 can be predicted accurately, according to the slope of the trend data of the residual potential of the organic photoreceptor 1 corrected based on the temperature of the organic photoreceptor 1.

According to the printer of the present embodiment, the potential sensor 10 detects the residual potential, by setting the charge potential of the organic photoreceptor 1 in the same condition. Accordingly, more accurate information of changes in the residual potential can be obtained.

According to the printer of the present embodiment, the life determining unit 12 that can determine the service life of the organic photoreceptor 1 accurately, and the informing unit 13 that informs at least one of the determination result and the prediction result obtained by the life determining unit 12 are provided. Accordingly, the organic photoreceptor 1 can be replaced at an appropriate timing, thereby enabling to reduce the downtime of the apparatus, and contribute to the improvement of the productivity as a result.

The present invention is not limited to the configuration of the printer shown in FIG. 1 and can adopt an arbitrary configuration. For example, the present invention is also applicable to a color image forming apparatus including a plurality of imaging units and an intermediate transfer body, or an intermediate transfer-type color image forming apparatus in which a plurality of developing devices are arranged around a single organic photoreceptor.

According to one aspect of the present invention, it is possible to provide a photoreceptor-life determining device that can accurately determine the service life of a photoreceptor and an image forming apparatus using the photoreceptor-life determining device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A device for determining an end of life of an organic photoreceptor, the device comprising:

a potential detecting unit that detects a residual potential of the organic photoreceptor;

a temperature detecting unit that detects temperature of the organic photoreceptor in either one of a direct manner and an indirect manner; and a life determining unit that determines the end of life of the organic photoreceptor based on the residual potential detected by the potential detecting unit and the temperature detected by the temperature detecting unit.

2. The device according to claim 1, wherein the temperature detecting unit indirectly detects the temperature of the organic photoreceptor by detecting internal temperature of an apparatus in which the organic photoreceptor is used.

3. The device according to claim 1, wherein the life determining unit corrects the residual potential detected by the potential detecting unit with the temperature detected by the temperature detecting unit to obtain a correction value, and determines the end of life of the organic photoreceptor by comparing the correction value with a predetermined set value.

4. The device according to claim 1, wherein the life determining unit corrects the residual potential detected by the potential detecting unit with the temperature detected by the temperature detecting unit to obtain a correction value, and determines the end of life of the organic photoreceptor from time series information of the correction value.

5. The device according to claim 1, wherein the life determining unit corrects the residual potential detected by the potential detecting unit with the temperature detected by the temperature detecting unit to obtain a correction value, and determines the end of life of the organic photoreceptor from transition of time series information of the correction value.

6. The device according to claim 1, wherein the potential detecting unit detects the residual potential of the organic photoreceptor with a same level of a charge potential of the organic photoreceptor.

7. The device according to claim 1, wherein the life determining unit further predicts the end of life of the organic photoreceptor, and the device further comprises an informing unit that informs at least one of a result of determination and a result of prediction of the end of life of the organic photoreceptor by the life determining unit.

8. A method of determining an end of life of an organic photoreceptor, the method comprising:

first detecting including detecting a residual potential of the organic photoreceptor;

second detecting including detecting temperature of the organic photoreceptor in either one of a direct manner and an indirect manner; and determining the end of life of the organic photoreceptor based on the residual potential detected at the first detecting and the temperature detected at the second detecting.

9. The method according to claim 8, wherein the detecting includes detecting indirectly the temperature of the organic photoreceptor by detecting internal temperature of an apparatus in which the organic photoreceptor is used.

10. The method according to claim 8, wherein the determining includes correcting the residual potential detected at the first detecting with the temperature detected at the second detecting to obtain a correction value, and determining the end of life of the organic photoreceptor by comparing the correction value with a predetermined set value.

11. The method according to claim 8, wherein the determining includes correcting the residual potential detected at the first detecting with the temperature detected at the second detecting to obtain a correction value, and determining the end of life of the organic photoreceptor from time series information of the correction value.

12. The method according to claim 8, wherein the determining includes correcting the residual potential detected at the first detecting with the temperature detected at the second detecting to obtain a correction value, and determining the end of life of the organic photoreceptor from transition of time series information of the correction value.

13. The method according to claim 8, wherein the first detecting includes detecting the residual potential of the photoreceptor with a same level of a charge potential of the organic photoreceptor.

14. The method according to claim 8, wherein the determining includes predicting the end of life of the organic photoreceptor, and the method further comprises informing at least one of a result of determination and a result of prediction of the end of life of the organic photoreceptor.

15. An image forming apparatus that includes an organic photoreceptor, a neutralizing unit that neutralizes a surface of the organic photoreceptor, a charging unit that uniformly charges the surface of the organic photoreceptor that is neutralized by the neutralizing unit, a latent-image forming unit that forms an electrostatic latent image on the surface of the organic photoreceptor, and a developing unit that develops the electrostatic latent image formed on the surface of the organic photoreceptor, the image forming apparatus comprising a photoreceptor life determining device for determining an end of life of the organic photoreceptor, wherein the photoreceptor life determining device includes a potential detecting unit that detects a residual potential of the organic photoreceptor, a temperature detecting unit that detects temperature of the organic photoreceptor in either one of a direct manner and an indirect manner, and a life determining unit that determines the end of life of the organic photoreceptor based on the residual potential detected by the potential detecting unit and the temperature detected by the temperature detecting unit.

16. The image forming apparatus according to claim 15, wherein the temperature detecting unit indirectly detects the temperature of the organic photoreceptor by detecting internal temperature of the image forming apparatus.

17. The image forming apparatus according to claim 15, wherein the life determining unit further predicts the end of life of the organic photoreceptor, and the photoreceptor life determining device further includes an informing unit that informs at least one of a result of determination and a result of prediction of the end of life of the organic photoreceptor by the life determining unit.

* * * * *